US012631038B2

(12) United States Patent
Kuai et al.

(10) Patent No.: US 12,631,038 B2
(45) Date of Patent: May 19, 2026

(54) VERTICAL CIRCULATION THREE-DIMENSIONAL GARAGE

(71) Applicant: SICHUAN GOLDSTONE-ORIENT NEW MATERIAL TECHNOLOGY CO., LTD., Chengdu (CN)

(72) Inventors: Yixi Kuai, Chengdu (CN); Liangyuan Wang, Chengdu (CN); Jin Wang, Chengdu (CN)

(73) Assignee: SICHUAN GOLDSTONE-ORIENT NEW MATERIAL TECHNOLOGY CO., LTD, Chengdu (CN)

( * ) Notice: Subject to any disclaimer, the term of this patent is extended or adjusted under 35 U.S.C. 154(b) by 417 days.

(21) Appl. No.: 18/263,045

(22) PCT Filed: Jul. 28, 2021

(86) PCT No.: PCT/CN2021/108985

§ 371 (c)(1),
(2) Date: Jul. 26, 2023

(87) PCT Pub. No.: WO2022/160630

PCT Pub. Date: Aug. 4, 2022

(65) Prior Publication Data

US 2024/0110399 A1 Apr. 4, 2024

(30) Foreign Application Priority Data

Jan. 26, 2021 (CN) ..... 202110105740.1
Jan. 26, 2021 (CN) ..... 202120215069.1

(51) Int. Cl.
*E04H 6/14* (2006.01)
*E04H 6/42* (2006.01)

(52) U.S. Cl.
CPC ..... *E04H 6/14* (2013.01); *E04H 6/42* (2013.01)

(58) Field of Classification Search
CPC ..... E04H 6/42; E04H 6/14
See application file for complete search history.

(56) References Cited

U.S. PATENT DOCUMENTS

2017/0306641 A1* 10/2017 Qi ..... B60L 53/00
2020/0094699 A1* 3/2020 Cheng ..... B60L 53/35
(Continued)

FOREIGN PATENT DOCUMENTS

CN 2271581 Y 12/1997
CN 201953115 U 8/2011
(Continued)

OTHER PUBLICATIONS

English translation of International Search Report from PCT/CN2021/108985 dated Oct. 28, 2021 (3 pages).

*Primary Examiner* — Kaitlin S Joerger
(74) *Attorney, Agent, or Firm* — Calfee, Halter & Griswold LLP

(57) ABSTRACT

The present disclosure relates to the field of parking equipment. Disclosed is a vertical circulation three-dimensional garage, comprising: a rack, the rack comprising a front main frame and a rear main frame arranged spaced apart from and opposite to each other and each having a traction chain mounted thereon; a plurality of car carrying plates, respectively connected to different positions of the traction chains; and a driving system, the driving system comprising a front shifting wheel, a rear shifting wheel, and an intermediate transmission mechanism transmittingly connected between the front shifting wheel and the rear shifting wheel, and the intermediate transmission mechanism comprising a central transmission shaft extending between the front main frame and the rear main frame and offset with respect to wheel centers of the front shifting wheel and the rear shifting wheel. According to the vertical circulation three-dimensional garage of the present disclosure, the space between (Continued)

the front shifting wheel and the rear shifting wheel in the space surrounded by an annular running area of the car carrying plates can be released, so as to facilitate, for example, free arrangement of charging cables, and avoid bending loss caused by bending and extending of the cables around the transmission shaft.

14 Claims, 5 Drawing Sheets

(56) References Cited

U.S. PATENT DOCUMENTS

| | | | | |
|---|---|---|---|---|
| 2022/0194240 | A1* | 6/2022 | Park | B60L 53/30 |
| 2023/0151628 | A1* | 5/2023 | Huch | B60L 53/60 414/248 |
| 2024/0026701 | A1* | 1/2024 | Kuai | E04H 6/42 |
| 2024/0110399 | A1 | 4/2024 | Kuai et al. | |

FOREIGN PATENT DOCUMENTS

| | | | |
|---|---|---|---|
| CN | 103806725 | A | 5/2014 |
| CN | 105155890 | A | 12/2015 |
| CN | 106285106 | A | 1/2017 |
| CN | 107571748 | A | 1/2018 |
| CN | 206971845 | U | 2/2018 |
| CN | 108952262 | A | 12/2018 |
| CN | 110388107 | A | 10/2019 |
| CN | 211776235 | U | 10/2020 |
| CN | 112780087 | A | 5/2021 |
| CN | 214942897 | U | 11/2021 |
| JP | 06032614 | U | 4/1994 |
| KR | 1020010109839 | A | 12/2001 |
| KR | 101399369 | B1 | 5/2014 |

* cited by examiner

VERTICAL CIRCULATION THREE-DIMENSIONAL GARAGE

CROSS-REFERENCE TO RELATED APPLICATIONS

This application is a 371 of PCT Application No. PCT/CN2021/108985 filed on Jul. 28, 2021, which claims the benefit of Chinese Patent Application Nos. 202110105740.1 and 202120215069.1 filed on Jan. 26, 2021, the contents of which are incorporated herein by reference.

FIELD

The present disclosure relates to the field of parking equipment, in particular to a vertical circulating parking system.

BACKGROUND

With the rapid growth of car ownership, parking difficulty has become a severe problem in the development of urbanization. More and more attention is paid to vertical circulating parking systems because of their small footprint, high utilization of land space and flexible layout. Typically, a vertical circulating parking system can drive a transmission mechanism via a gear motor, and thereby drive a plurality of parking baskets arranged on traction chains at intervals to move in loops in a runway-shaped (annular) running area along with the traction chains, so as to attain a purpose of accessing cars.

In order to ensure the synchronous operation of the traction chains at the front and rear ends of the parking baskets, in traditional vertical circulating parking systems, the front shifting wheel and the rear shifting wheel that are respectively engaged with the lower parts of the front traction chain and the rear traction chain are usually connected coaxially, so that when either of the shifting wheels is driven by a driving motor to rotate, the other shifting wheel is driven to rotate synchronously, thereby the front traction chain and the rear traction chain are driven to run synchronously. In that case, a transmission shaft for transmission is connected between the front shifting wheel and the rear shifting wheel, and the center of axis of the transmission shaft is in the same line as the centers of the front shifting wheel and the rear shifting wheel; for example, the front shifting wheel and the rear shifting wheel can be directly and fixedly mounted at the two ends of the transmission shaft.

The form of transmission of such a transmission shaft seriously limits the development of vertical circulating parking system technology. For example, as the technology of new energy vehicles, represented by electric vehicles, has become increasingly matured, and vertical circulating parking systems with a charging function have emerged as the times require. In order to avoid unnecessary energy consumption and wear of the charging cables when they are released and wound along with the movement of the parking baskets, the charging cables connected with a plurality of parking baskets may be arranged in a centralized cable outgoing form, and they diverge and extend from the cable outlet unit to the individual parking baskets. However, since it is necessary to reserve charging cables with sufficient extension length between the cable outlet unit and the parking baskets when such a cable outgoing arrangement is utilized to adapt to different parking positions of the parking baskets, it is required to provide a fully empty space in the space surrounded by the annular running area of the parking baskets to avoid or reduce the effect of the above-mentioned transmission shaft on the charging cable arrangement and service life.

SUMMARY

The object of the present disclosure is to solve the problem that the existence of a transmission shaft in a vertical circulating parking system limits the arrangement and operation of the components in the prior art, and provide a vertical circulating parking system, in which the space between the front shifting wheel and the rear shifting wheel is released, thereby the convenience of arrangement of components and devices, e.g., charging cables, is improved.

To attain the above-mentioned object, the present disclosure provides a vertical circulating parking system, which comprises:

- a rack, comprising a front main frame and a rear main frame that are arranged apart from and opposite to each other and provided with traction chains respectively;
- a plurality of parking baskets, each of which is respectively connected to different positions of the traction chains in a way that it can be pivoted with respect to the traction chains, so that the car carrying baskets can be kept in a horizontal state at different parking positions in an annular running area as the traction chains operate; and
- a driving system, comprising a front shifting wheel and a rear shifting wheel that are respectively engaged with the traction chains mounted on the front main frame and the rear main frame, and an intermediate transmission mechanism transmittingly connected between the front shifting wheel and the rear shifting wheel, wherein the intermediate transmission mechanism comprises a central transmission shaft that extends between the front main frame and the rear main frame and is offset with respect to the centers of the front shifting wheel and the rear shifting wheel.

Preferably, the front shifting wheel and the rear shifting wheel are arranged coaxially.

Preferably, the front shifting wheel and the rear shifting wheel are respectively engaged with the lower parts of corresponding traction chains.

Preferably, the intermediate transmission mechanism comprises a first chain transmission device connected between the front shifting wheel and the central transmission shaft and arranged near the front main frame, and a second chain transmission device connected between the central transmission shaft and the rear shifting wheel and arranged near the rear main frame.

Preferably, the first chain transmission device and the second chain transmission device are in a multi-stage transmission design respectively and arranged in a way that the front shifting wheel and the rear shifting wheel can be driven to rotate synchronously.

Preferably, the driving system comprises a driving motor mounted on one of the front main frame and the rear main frame, and one of the front shifting wheel and the rear shifting wheel can be driven by the driving motor and the other of the front shifting wheel and the rear shifting wheel can be driven to rotate synchronously via the intermediate transmission mechanism.

Preferably, the driving motor is provided with a braking device, which is provided with a brake shifting lever for releasing the braking state, and the brake shifting lever is connected with a braking wire.

Preferably, the central transmission shaft is arranged in a space surrounded by the annular running area where the plurality of parking baskets is located.

Preferably, the central transmission shaft is arranged in a vertical central plane where the running centers of the traction chains are respectively mounted on the front main frame and the rear main frame, and/or the elevation of the central transmission shaft is higher than a line connecting the centers of the area surrounded by the traction chains mounted on the front main frame and the rear main frame respectively by 0-2.5 meters.

Preferably, the vertical circulating parking system comprises a charging system, which comprises a central cable outlet unit arranged around the central transmission shaft, charging assemblies arranged on the parking basket respectively and a plurality of charging cables diverging from the central cable outlet unit and extending to each charging assembly respectively to supply power to the charging assemblies.

Preferably, a cable bracket with two ends connected to the front main frame and the rear main frame respectively is sleeved on the central transmission shaft, and the central cable outlet unit is mounted on the cable bracket in a way that it arranged around the central transmission shaft.

Preferably, the central cable outlet unit is mounted at a middle section of the cable bracket, and the charging assemblies are arranged at one end of each of the parking baskets near the front main frame or the rear main frame.

Preferably, the charging assemblies are arranged at one end of each of the parking baskets near the rear main frame, and the charging cables diverge and extend to the parking baskets correspondingly from the central cable outlet unit toward the front main frame and extend to the charging assemblies along a top beam of each parking basket.

Preferably, the charging cables extend along the cable bracket from the side of the rear main frame, and pass through the central cable outlet unit and diverge and extend correspondingly to the parking baskets.

Preferably, a spacer collar is freely sleeved on the cable bracket, and is arranged to separate a part of each charging cable extending from the central cable outlet unit to the corresponding charging assembly from the cable bracket.

With the above technical scheme, in the vertical circulating parking system according to the present disclosure, the central transmission shaft for transmission is arranged to be offset with respect to the centers of the front shifting wheel and the rear shifting wheel, so that the space between the front shifting wheel and the rear shifting wheel in the space surrounded by the annular running area of the parking baskets can be released; for example, in a vertical circulating parking system that employs a centralized cable outgoing design and has a charging function, the extension lengths of the charging cables can be moderate, the charging cables can be arranged freely, thereby the bending loss of the charging cables caused by bending and extending around the transmission shaft can be avoided.

REFERENCE NUMBERS

1—front main frame; 2—rear main frame; 3—upper frame; 4—parking basket; 5—traction chain; 6—front shifting wheel; 7—rear shifting wheel; 8—central transmission shaft; 9—driving motor; 91—brake shifting lever; 92—braking wire; 10—motor sprocket; 11—front transmission chain; 12—driving sprocket; 13—first sprocket; 14—second sprocket; 15—third sprocket; 16—fourth sprocket; 17—fifth sprocket; 18—sixth sprocket; 19—seventh sprocket; 20—eighth sprocket; 21—first chain; 22—second chain; 23—third chain; 24—fourth chain; 25—bearing seat; 26—cable bracket; 27—central cable outlet unit; 28—charging assembly; 29—charging cable; 30—triangular plate of parking basket; 31—spacer collar.

DETAILED DESCRIPTION

Some embodiments of the present disclosure will be detailed below with reference to the accompanying drawings. It should be understood that the embodiments described herein are only provided to describe and explain the present disclosure, but are not intended to constitute any limitation to the present disclosure.

In the present disclosure, unless otherwise specified, the terms that denote the orientations are used as follows, for example: "top" and "bottom" usually refer to "top" and "bottom" as shown in the accompanying drawings; "inside" and "outside" refer to inside and outside in relation to the profiles of the components. For the convenience of clear explanation, in view of the fact that a car usually runs into an vertical circulating parking system from the front side of the vertical circulating parking system, i.e., in the car entry direction shown in FIGS. 1 and 5 (front left to right), when the car is to be parked in the vertical circulating parking system, the orientational terms "front" and "rear" used in the present disclosure, such as front main frame 1 and rear main frame 2, usually correspond to the left and right directions shown in FIGS. 1 and 5; the orientational terms "left" and "right" usually correspond to the left and right directions in shown in FIG. 3.

Figure 1:
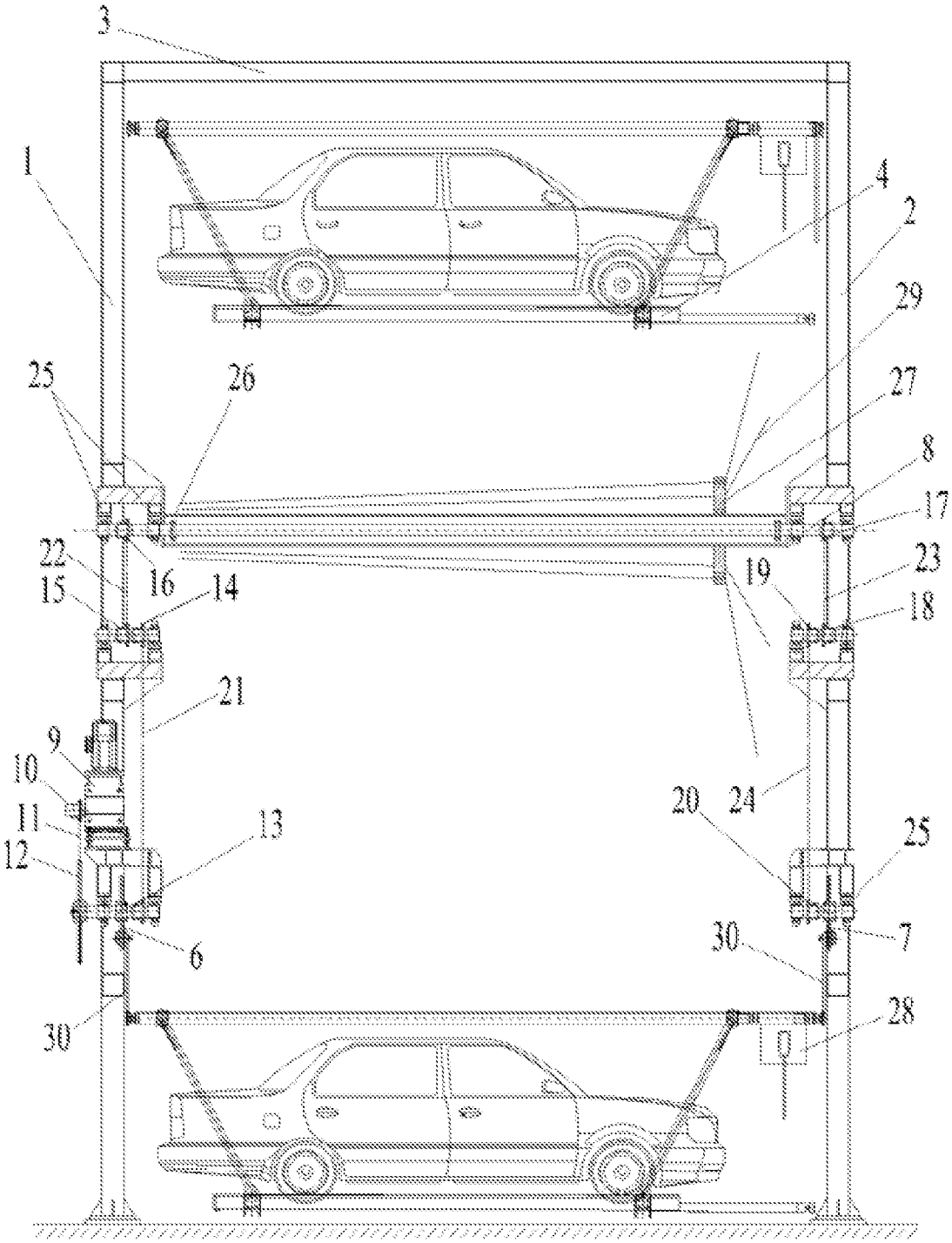
FIG. 1 is a schematic front view of the vertical circulating parking system according to a preferred embodiment of the present disclosure.
Figure 2:
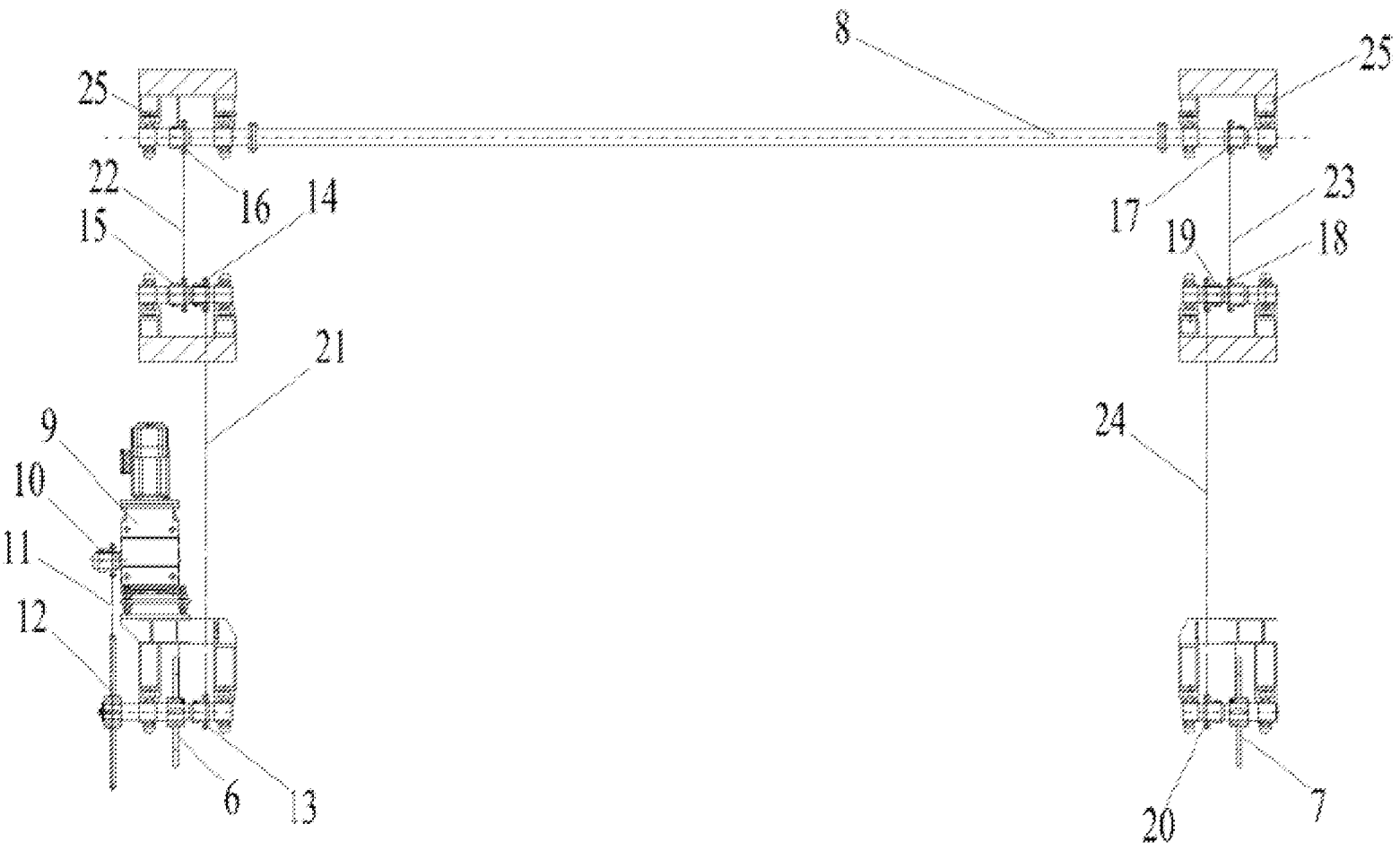
FIG. 2 is a schematic structural diagram of the driving system of the vertical circulating parking system in FIG. 1.
Figure 3:
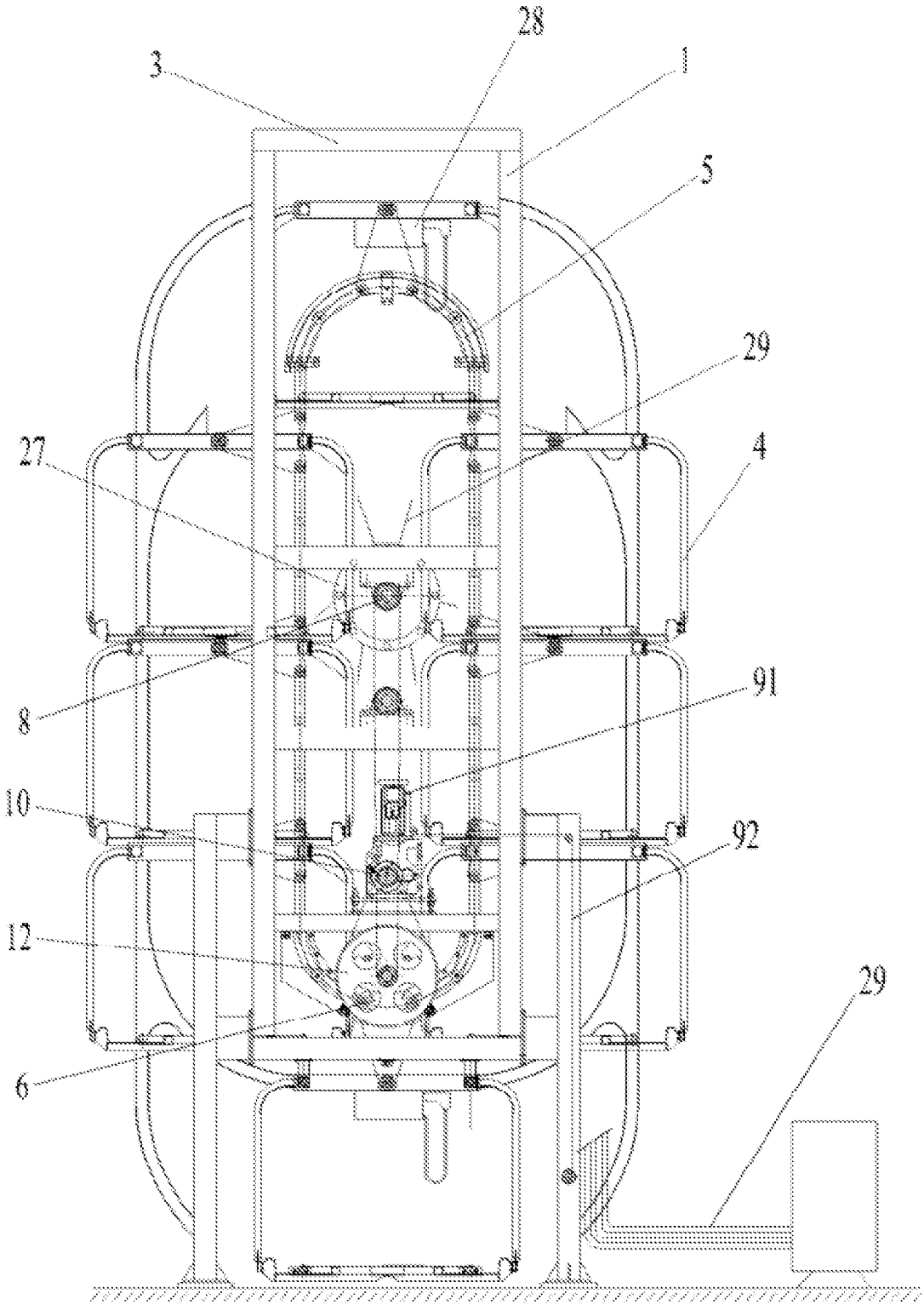
FIG. 3 is a left view of the vertical circulating parking system in FIG. 1.

As shown in FIGS. 1-3, the vertical circulating parking system according to a preferred embodiment of the present disclosure comprises a rack, a plurality of parking baskets 4, and a charging system, etc. The rack comprises a front main frame 1 and a rear main frame 2 that are arranged apart from and opposite to each other and provided with a traction chain 5 thereon respectively. To facilitate presenting the key components and their connection relationships, FIG. 1 only shows some related components from the perspective of a vertical cross section, while the traction chains and other components are omitted. Generally, the rack may be formed by steel profiles welded together, and serve as a mounting base and a bearing base for the function components, such as parking baskets 4, etc.

In order to ensure that the rack has high overall stability, in the vertical circulating parking system according to a preferred embodiment of the present disclosure, an upper frame 3 and a lower frame 4 may be connected between the front main frame 1 and the rear main frame 2. It should be understood that the front main frame 1 and the rear main frame 2 may be fixed on the ground by anchor bolts alternatively, and the integrity of them can be enhanced by providing a reinforced concrete foundation.

The traction chains 5 mounted on the front main frame 1 and the rear main frame 2 may be arranged in a racetrack form in the vertical plane and opposite to each other, and can be driven to run in their respective extension directions by driving devices such as motors and intermediate transmission devices such as a front shifting wheel 6 and a rear shifting wheel 7, etc. The plurality of parking baskets 4 are respectively connected to different positions of the traction chains 5 (e.g., via the triangular plates 30 of the parking baskets) in a way that they can pivot with respect to the traction chains 5, so that the parking baskets can be moved to different parking positions and kept in a horizontal state at the parking positions in an annular running area as the traction chains 5 operate. It can be understood that the parking baskets 4 move in the extension direction of the traction chains 5 as the traction chain 5 operate; however, to keep the cars 30 (not labeled in the figures) in the parking positions reliably, the parking baskets 4 should be kept in a horizontal state. Therefore, it is necessary to connect the parking baskets 4 in a way that they can pivot with respect to the traction chains 5.

Moreover, as the parking baskets 4 move between different parking positions, all the running areas of the parking baskets 4 form an annular running area (when the parking baskets 4 are not allowed to move along the traction chains 4 for a full loop, a single parking basket 4 can only pass through a part of the annular running area), and, at different positions of the vertical cross section, the cross section of the annular running area and the racetrack-formed plane surrounded by the traction chains 5 form similar figures parallel to each other. For example, in the vertical circulating parking system with eight evenly distributed parking baskets 4 as shown in FIG. 3, when the traction chains 4 are driven to run counterclockwise so that the bottommost parking basket 4 moves to the position of the topmost parking basket 4, the topmost parking basket 4 just moves to the bottommost car carrying plate 4. That is to say, (suppose) the parking baskets 4 are allowed to move along the traction chains 5 for a loop, the spatial areas swept by the parking baskets 4 superpose each other, i.e., the annular running area. In other embodiments, the vertical circulating parking system may have a different number of parking baskets 4, such as 12 or 16 parking baskets.

The vertical circulating parking system according to the present disclosure further has a driving system, which comprises a front shifting wheel 6, a rear shifting wheel 7 and an intermediate transmission mechanism transmittingly connected between the front shifting wheel 6 and the rear shifting wheel 7. The front shifting wheel 6 is engaged with the traction chain 5 mounted on the front main frame 1, and the rear shifting wheel 7 is engaged with the traction chain 5 mounted on the rear main frame 2. The intermediate transmission mechanism comprises a central transmission shaft 8 that extends between the front main frame 1 and the rear main frame 2 and is offset from the centers of the front shifting wheel 6 and the rear shifting wheel 7, and the central transmission shaft 8 can be pivotally mounted on the front main frame 1 and the rear main frame 2 via bearing seats 25. In order to facilitate disassembly, the central transmission shaft 8 may be composed of a plurality of sections connected by couplings.

Thus, unlike traditional garages in which the transmission shaft and the front and rear shifting wheels are coaxially arranged at the bottom of the annular area surrounded by the traction chains in the prior art, the central transmission shaft 8 for transmission in the present disclosure is configured to be offset from the centers of the front shifting wheel 6 and the rear shifting wheel 7, thereby the space between the front shifting wheel 6 and the rear shifting wheel 7 in the space surrounded by the annular operation area of the parking baskets 4 is released. For example, in a vertical circulating parking system that employs a centralized cable outgoing design and has a charging function, the extension lengths of the charging cables can be moderate, the charging cables can be arranged freely, and the bending loss of the charging cables caused by running and bending around the transmission shaft can be avoided.

In other words, the vertical circulating parking system according to the present disclosure has a driving system arrangement structure completely different from that in the prior art, and the central transmission shaft 8 is arranged to be offset with respect to the front shifting wheel 6 and the rear shifting wheel 7, thereby the convenience in the arrangement of related components and devices is significantly improved. For example, when freely extending charging cables are to be arranged in the space surrounded by the annular running area of the parking baskets 4, the charging cables don't have to run over the bottom transmission shaft connected between the front shifting wheel 6 and the rear shifting wheel 7 as in the case in the prior art; therefore, the extension lengths of the charging cables don't have to be very long to meet the requirement for charging of the parking baskets at different parking positions, and the bending loss of the charging cables incurred by a large bending angle of the charging cables can be avoided.

It should be noted that although the present disclosure puts forward a structural arrangement of the driving system based on the requirement of the technical development of the vertical circulating parking system with a charging function and solves the problem that the transmission shaft affects the arrangement and service life of the charging cables, the vertical circulating parking system in the present disclosure is not limited to a charging garage; alternatively, the vertical circulating parking system may be a non-charging garage. By using the central transmission shaft 8 to transmit the power between the front shifting wheel 6 and the rear shifting wheel 7, the space at the position where the garage is relatively near the ground can be released, and can be used to arrange any other safety facility except the above-mentioned charging cables; for example, a fire hose extending into the space may be connected on the front main frame 1 and the rear main frame 2.

To avoid large space occupation, as shown in the figures, the central transmission shaft 8 is arranged in the space surrounded by the annular running area where the parking baskets 4 are located. In other embodiments, the central transmission shaft 8 may be arranged at a different position offset from the centers of the front shifting wheel 6 and the rear shifting wheel 7, as long as it does not interfere with the operation of the parking baskets 4. Preferably, the central transmission shaft 8 is arranged in a vertical central plane where the running centers of the traction chains 5 mounted on the front main frame 1 and the rear main frame 2 are located respectively, so that the distances between the central cable outlet unit 27 and the parking baskets 4 is essentially the same as described later.

In the preferred embodiment shown in the figures, the front shifting wheel 6 and the rear shifting wheel 7 are arranged in the same axial line near the lower part of the traction chains 5, and are respectively engaged with the corresponding traction chains 5 on the front main frame 1 and the rear main frame 2. In other embodiments, the front shifting wheel 6 and the rear shifting wheel 7 can cooperate with the traction chains 5 at different positions; for example, the front shifting wheel 6 still cooperates with the lower part of the traction chain 5 mounted on the front main frame 1 as illustrated, and the rear shifting wheel 7 cooperates with the upper part of the traction chain 5 mounted on the rear main frame 2. Keeping the front shifting wheel 6 and the rear shifting wheel 7 in the same positions as those in the prior art is conducive to the convenience of installation and maintenance.

As described above, in a preferred embodiment, the central transmission shaft 8 may be located near the central parts of the traction chains 5 in the height direction with respect to the front shifting wheel 6 and the rear shifting wheel 7 to release the lower space. In that case, the central transmission shaft 8 has a greater radial offset with respect to the front shifting wheel 6 and the rear shifting wheel 7, and the power transmission path is longer. To that end, chain transmission may be used between the front shifting wheel 6 and the central transmission shaft 8 and between the central transmission shaft 8 and the rear shifting wheel 7 to transmit power. Specifically, the intermediate transmission mechanism for transmission between the front shifting wheel 6 and the rear shifting wheel 7 may comprise a first chain transmission device that is connected between the front shifting wheel 6 and the central transmission shaft 8 and arranged near the front main frame 1, and a second chain transmission device that is connected between the central transmission shaft 8 and the rear shifting wheel 7 and arranged near the rear main frame 2. Thus, the requirement for transmission in a long path can be met, and synchronous rotation of the front shifting wheel 6 and the rear shifting wheel 7 can be maintained by reasonably arranging the diameters or the transmission ratio of the sprockets.

For example, in the preferred embodiment shown in the figures, the front shifting wheel 6 and the rear shifting wheel 7 are mounted on the rack via bearing seats 25 respectively. A first sprocket 13 is coaxially mounted on the shaft where the front shifting wheel 6 is mounted, and the first sprocket 13 is engaged and connected with a first chain 21 that is engaged and connected with a second sprocket 14; the second sprocket 14 is coaxially mounted with a third sprocket 15, and the third sprocket 15 is engaged and connected with a second chain 22 that is engaged and connected with a fourth sprocket 16, wherein the fourth sprocket 16 is fixedly connected to the central transmission shaft 8. Thus, the first sprocket 13, the second sprocket 14, the third sprocket 15, the fourth sprocket 16, and the first chain 21 and the second chain 22 connected therebetween constitute the aforesaid first chain transmission device, which can transmit the power from the front shifting wheel 6 to the central transmission shaft 8. Symmetrically, the second chain transmission device may comprise a fifth sprocket 17 fixedly mounted on the central transmission shaft 8, a sixth sprocket 18 and a seventh sprocket 19 that are coaxially mounted, an eighth shifting wheel 20 coaxially mounted with the rear shifting wheel 7, and a third chain 23 and a fourth chain 24 connected therebetween for transmitting the power from the central transmission shaft 8 to the rear shifting wheel 7. The two sprockets that are engaged and connected with the same chain may have the same number of teeth; for example, the first sprocket 13 and the second sprocket 14 are of the same specification, and the third sprocket 15 and the fourth sprocket 16 are of the same specification, so that the transmission ratio of the first chain transmission device is 1.

In this preferred embodiment, the first chain transmission device and the second chain transmission device employ two-stage transmission respectively. In other embodiments, one-stage transmission or multi-stage transmission is employed between the central transmission shaft 8 and the front shifting wheel 6 and/or the rear shifting wheel 7, depending on the height of parking spaces in the garage and other factors.

Via the above-mentioned intermediate transmission mechanism, the front shifting wheel 6 and the rear shifting wheel 7 may be driven to rotate synchronously, so as to drive the traction chains 5 mounted on the front main frame 1 and the rear main frame 2 respectively to run synchronously. In that case, as long as any one of the driving systems is driven, the parking operation of the vertical cycle three-dimensional garage can be realized. Typically, the driving system comprises a driving motor 9 mounted on one of the front main frame 1 and the rear main frame 2, and one of the front shifting wheel 6 and the rear shifting wheel 7 can be driven by the driving motor 9 and the other of the front shifting wheel 6 and the rear shifting wheel 7 can be driven to rotate synchronously via the intermediate transmission mechanism. In the preferred embodiment shown in the figures, the driving motor 9 is mounted at the side of the front main frame 1, and a motor sprocket 10 is mounted on the power output shaft of the motor. The motor sprocket 10 is transmittingly connected to a driving sprocket 12 coaxially mounted with the front shifting wheel 6 via a front transmission chain 11, and the number of teeth of the driving sprocket 12 is greater than that of the motor sprocket 10, so that the power outputted from the driving motor 9 can be geared down and transmitted to the front shifting wheel 6, and the rear shifting wheel 7 can be driven to rotate synchronously via the intermediate transmission mechanism.

Figure 4:
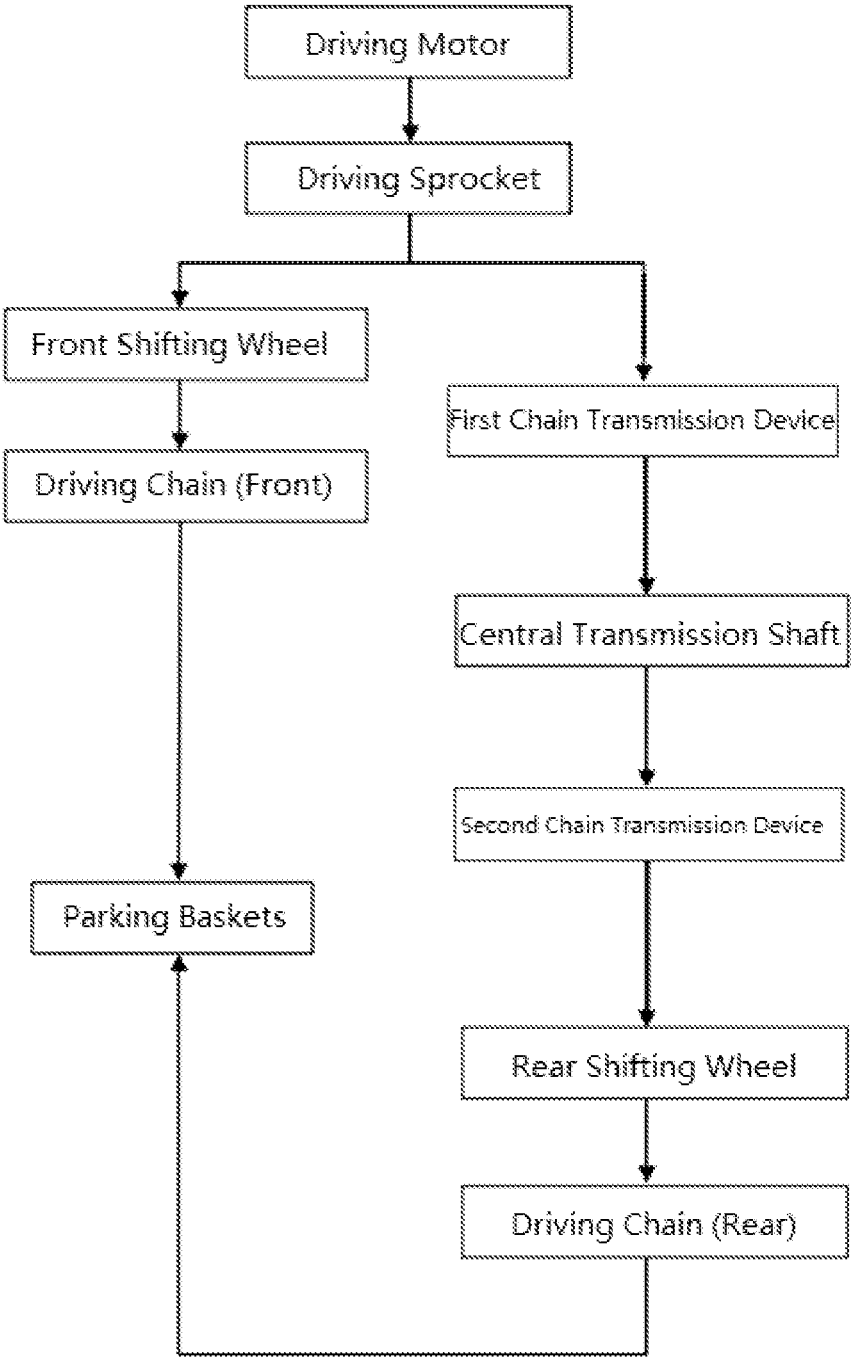
FIG. 4 shows the transmission path of the driving system of the vertical circulating parking system in FIG. 1.

FIG. 4 shows the transmission path from the driving motor to the parking baskets. The power outputted from the driving motor 9 is transmitted to the driving sprocket 12 via the motor sprocket 10 and the front transmission chain 11, so as to reduce the speed and increase the torque. The driving sprocket 12, the front shifting wheel 6 and the first sprocket 13 are mounted on the same shaft, thereby they rotate synchronously, and the front shifting wheel 6 drives the traction chain 5 mounted on the front main frame 1 to run. The rotation of the first sprocket 13 is transmitted to the fourth sprocket 16 via the first chain 21, the second sprocket 14, the third sprocket 15 and the second chain 22 sequentially, and the central transmission shaft 8 is driven to rotate because the fourth sprocket 16 is fixed to the central transmission shaft 8. The central transmission shaft 8 in turn outputs power forward via the fifth sprocket 17 near the end of the rear main frame 2, and drives the eighth sprocket 20 to rotate via the third chain 23, the sixth sprocket 18, the seventh sprocket 19 and the fourth chain 24 sequentially. The eighth sprocket 20 is mounted on the same shaft as the rear shifting wheel 7, thereby the traction chain 5 mounted on the rear main frame 2 is driven to run synchronously with the traction chain 5 mounted on the front main frame 1. The traction chains 5 mounted on the front main frame 1 and the rear main frame 2 drive the triangular plates 30 at the front and rear ends of the parking baskets 4 to move along the extension direction of the traction chains 5, so as to change the position of the parking baskets 4. In that process, the parking baskets 4 pivot with respect to the triangular plates 30 and the traction chains 5 to maintain in a horizontal state.

In case of power failure in the garage, the driving motor 9 can be configured to brake automatically to avoid accidents. To that end, the driving motor 9 may be provided with a braking device therein, which is provided with a brake shifting lever 91 for releasing the braking state, and the brake shifting lever 91 is connected with a braking wire 92. Thus, the driving motor 9 may be released from the braking state manually, and the cars parked in the garage can be withdrawn conveniently in the case of power failure. In order to facilitate the operators to manipulate, the braking wire 92 may extend downward from the driving motor 9 to a position near the ground.

Furthermore, the parking baskets 4 may be provided with a charging assembly, such as a charger and a charging gun electrically connected to the charger. Each of the parking baskets 4 may be provided with a charging assembly. Alternatively, in other embodiments, charging assemblies may be provided only at some of the parking baskets 4, so that only some parking spaces in the vertical circulating parking system have the charging function. In order to provide electric power to the charging assemblies, the charging system further comprises a central cable outlet unit 27 and a plurality of charging cables 29 correspondingly diverging and extending from the central cable outlet unit 27 to the charging assemblies 28, besides the charging assemblies. In other words, the charging cables 29 connecting the charging assemblies 28 are led out centrally and diverge from the central cable outlet unit 27. The central cable outlet unit 27 is electrically connected to an external power supply unit such as a power supply cabinet, so that it can supply power to the charging assemblies 28 through the charging cables 29.

As shown in FIG. 1, in a preferred embodiment, in order to prevent the aforesaid central transmission shaft 8 from affecting the arrangement and extension of the charging cables 29, a cable bracket 26 may be sleeved on the central transmission shaft 8, with two ends of the cable bracket 26 connected to the front main frame 1 and the rear main frame 2 respectively, and the central cable outlet unit 27 may be mounted on the cable bracket 26 and arranged around the central transmission shaft 8. Thus, when the charging cables 29 extend from the central cable outlet unit 27 to the charging assemblies 28 on the parking baskets 4, there is no object blocking the extension of the charging cables 29 in the space surrounded by the annular operation area where the parking baskets 4 are located, and the charging cables 29 can freely droop, and cable bending around the shaft can be avoided. The charging cables connected to the central cable outlet unit 27 from the external power supply unit may extend along the cable bracket 26, so that they can be essentially fixed on the outer surface of the cable bracket 26 or inside the cable bracket 26.

Usually, the charging assembly 28 may be suspended over one end of the parking basket 4 near the rear main frame 2, so as avoid affecting the entry of the car onto the parking basket 4 from the side of the front main frame 1. In other embodiments, alternatively the charging assembly 28 may be suspended over one end of the parking basket 4 near the front main frame 1 or directly mounted on a car pallet.

Figure 5:
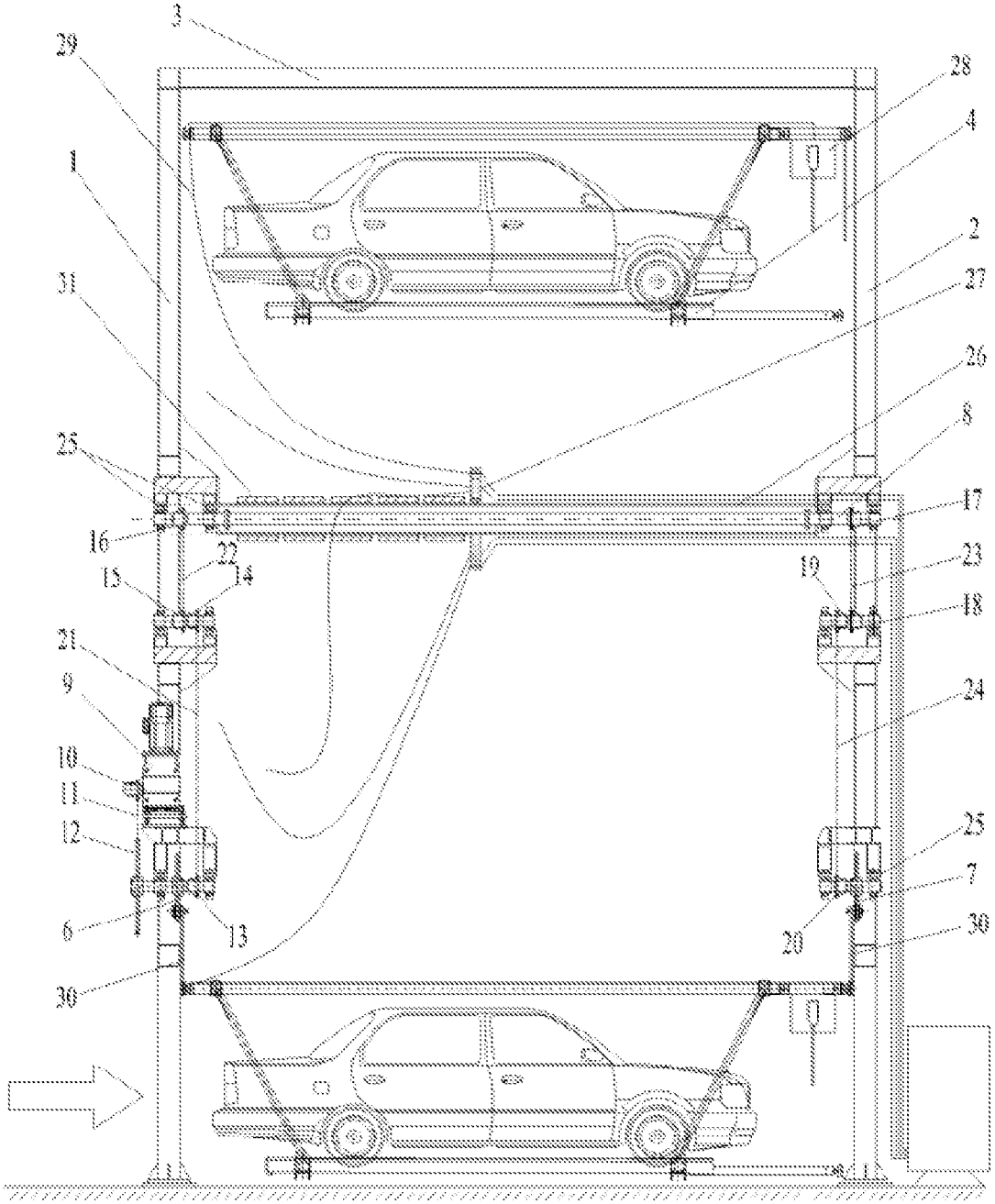
FIG. 5 is a schematic front view of the vertical circulating parking system according to another preferred embodiment of the present disclosure.

FIG. 5 is a schematic front view of the vertical circulating parking system according to another preferred embodiment of the present disclosure. The driving system and other structures are the same as those in the aforesaid preferred embodiment, and will not be described in detail below. Compared with the preferred embodiment shown in FIG. 1, the difference of the vertical circulating parking system in this embodiment mainly lies in the extension path of the charging cables 29 and the arrangement of related components.

Specifically, different from the arrangement of the central cable outlet unit at a position of the cable bracket near the charging assembly (rear end) in the aforesaid preferred embodiment, the central cable outlet unit 27 is mounted at a middle section of the cable bracket 26 in this preferred embodiment, thereby the bending radius of the charging cables 29 extending from the central cable outlet unit 27 to the charging assemblies 28 are greater, and the bending loss can be reduced. Here, the middle section of the cable bracket 26 is at the midpoint of the cable bracket 26 in the front-rear direction of the garage or a position adjacent to the midpoint, which is to say, the central cable outlet unit 27 is mounted near the midpoint of the cable bracket 26 in the front-rear direction of the garage.

In the illustrated preferred embodiment, the charging assemblies 28 are arranged at the end of each parking basket 4 near the rear main frame 2, and the charging cables 29 diverge and extend from the central cable outlet unit 27 toward the front main frame 1 to each parking basket 4, and extend to the charging assemblies 28 along the top beams of the parking basket 4. Compared with the preferred embodiment shown in FIG. 1, the charging cables 29 extend from the front side of each parking basket 4 to avoid the interference of guide wheel struts, and the wiring arrangement is more convenient.

The charging cables 29 may extend from a charging cabinet, through the rear main frame 2 to an area between the front main frame 1 and the rear main frame 2, to the central cable outlet unit 27 along the cable bracket 26. The charging cables 29 passes through the central cable outlet unit 27 and correspondingly diverge and extend to the parking baskets 4, thereby the existence of cable joints in the extension area from charging cabinet to the parking baskets 4 is avoided and the risk of electric leakage is decreased.

a spacer collar 31 is freely sleeved on the portion of the cable bracket 26 between the central cable outlet unit 27 and the front main frame 1, which is to say, the spacer collar 31 can freely rotate on the cable bracket 26. Thus, the portion of each of the charging cables 29 extending from the central cable outlet unit 27 to the corresponding charging assembly 28 is separated from the cable bracket 26; when the charging cables 29 freely droop in the space, they can rotate freely on the cable bracket 26 along with the spacer collar 31, so as to reduce wear.

Theoretically, in the above preferred embodiment, if the distance between the central cable outlet unit 27 and the charging assembly 28 on the topmost parking basket is equal to the distance between the central cable outlet unit 27 and the charging assembly 28 on the bottommost parking basket, the charging cables 29 can have the shortest extension length after they extend out of the central cable outlet unit 7. However, to avoid any tension damage resulted from dimension errors, usually the charging cables 29 are configured to be longer than their theoretical length. In that case, the distance from the center of the area surrounded by the traction chains to the top beam of the topmost parking basket is equal to the distance from that center to the top beam of the bottommost parking basket; if the central cable outlet unit 27 is arranged at the elevation of the center of the area, the freely drooping charging cables 29 will come into contact with the top beam of the bottommost parking basket and cause abrasion. In view of that problem, the central cable outlet unit 27 (i.e., the central transmission shaft 8)

may be arranged at an elevation higher than a line connecting the centers of the area surrounded by the two traction chains mounted on the front main frame 1 and the rear main frame 2 by 0-2.5 meters, to avoid or minimize the contact between the charging cables with adequate reserved length and the top beam of the bottommost parking basket in a free droop state of the charging cables.

While the present disclosure is described above in detail in some preferred embodiments with reference to the accompanying drawings, the present disclosure is not limited to those embodiments. Various simple variations may be made to the technical scheme in the present disclosure, including combinations of the specific technical features in any appropriate form, within the scope of the technical ideal of the present disclosure. To avoid unnecessary repetition, various possible combinations are not described specifically in the present disclosure. However, such simple variations and combinations shall also be deemed as having been disclosed and falling in the scope of protection of the present disclosure.

The invention claimed is:

1. A vertical circulating parking system, comprising:

a rack comprising a front main frame and a rear main frame that are arranged apart from and opposite to each other and provided with a traction chain thereon respectively;

a plurality of parking baskets, each of which is respectively connected to different positions of the traction chain in a way that it can be pivoted with respect to the traction chain, so that the parking baskets can be kept in a horizontal state at different parking positions in an annular running area as the traction chain operate; and a driving system, comprising a front shifting wheel and a rear shifting wheel that are respectively engaged with the traction chain mounted on the front main frame and the rear main frame, and an intermediate transmission mechanism transmittingly connected between the front shifting wheel and the rear shifting wheel, wherein the intermediate transmission mechanism comprises a central transmission shaft that extends between the front main frame and the rear main frame and is offset with respect to the centers of the front shifting wheel and the rear shifting wheel wherein the intermediate transmission mechanism comprises a first chain transmission device connected between the front shifting wheel and the central transmission shaft and arranged near the front main frame, and a second chain transmission device connected between the central transmission shaft and the rear shifting wheel and arranged near the rear main frame.

2. The vertical circulating parking system of claim 1, wherein the front shifting wheel and the rear shifting wheel are arranged coaxially.

3. The vertical circulating parking system of claim 2, wherein the front shifting wheel and the rear shifting wheel are respectively engaged with the lower parts of corresponding traction chains.

4. The vertical circulating parking system of claim 1, wherein the first chain transmission device and the second chain transmission device are in a multi-stage transmission design respectively and arranged in a way that the front shifting wheel and the rear shifting wheel are driven to rotate synchronously.

5. The vertical circulating parking system of claim 1, wherein the driving system comprises a driving motor mounted on one of the front main frame and the rear main frame, and one of the front shifting wheel and the rear shifting wheel is driven by the driving motor and the other of the front shifting wheel and the rear shifting wheel is driven to rotate synchronously via the intermediate transmission mechanism.

6. The vertical circulating parking system of claim 5, wherein the driving motor is provided with a braking device, which is provided with a brake shifting lever for releasing a braking state, and the brake shifting lever is connected with a braking wire.

7. The vertical circulating parking system of claim 1, wherein the central transmission shaft is arranged in a space surrounded by the annular running area where the plurality of parking baskets are located.

8. The vertical circulating parking system of claim 7, wherein the central transmission shaft is arranged in a vertical central plane where the running centers of the traction chains are respectively mounted on the front main frame and the rear main frame, and/or the elevation of the central transmission shaft is higher than a line connecting the centers of the area surrounded by the traction chains mounted on the front main frame and the rear main frame respectively by 0-2.5 meters.

9. The vertical circulating parking system of claim 7, wherein the vertical circulating parking system comprises a charging system, which comprises a central cable outlet unit arranged around the central transmission shaft, charging assemblies arranged on the parking baskets respectively and a plurality of charging cables diverging from the central cable outlet unit and extending to each charging assembly respectively to supply power to the charging assemblies.

10. The vertical circulating parking system of claim 9, wherein a cable bracket with two ends connected to the front main frame and the rear main frame respectively is sleeved on the central transmission shaft, and the central cable outlet unit is mounted on the cable bracket in a way that it arranged around the central transmission shaft.

11. The vertical circulating parking system of claim 10, wherein the central cable outlet unit is mounted at a middle section of the cable bracket, and the charging assemblies are arranged at one end of each of the parking baskets near the front main frame or the rear main frame.

12. The vertical circulating parking system of claim 11, wherein the charging assemblies are arranged at one end of each of the parking baskets near the rear main frame, and the charging cables diverge and extend to the parking baskets correspondingly from the central cable outlet unit toward the front main frame and extend to the charging assemblies along a top beam of each parking basket.

13. The vertical circulating parking system of claim 12, wherein the charging cables extend along the cable bracket from the side of the rear main frame, and pass through the central cable outlet unit and diverge and extend correspondingly to the parking baskets.

14. The vertical circulating parking system of claim 10, wherein a spacer collar is freely sleeved on the cable bracket, and is arranged to separate a part of each charging cable extending from the central cable outlet unit to the corresponding charging assembly from the cable bracket.

* * * * *